US005597037A

United States Patent [19]

Asada et al.

[11] Patent Number: 5,597,037

[45] Date of Patent: Jan. 28, 1997

[54] HEAT EXCHANGING APPARATUS

[75] Inventors: Kazuhiko Asada; Koichi Ueno; Shin-ichiro Kashihara; Shigemi Okamoto; Katsuo Kurose; Kazuhiko Kuwahara; Ken-ichiro Mitsuhashi, all of Takasago, Japan

[73] Assignee: Kabushiki Kaisha Kobe Seiko Sho, Kobe, Japan

[21] Appl. No.: 532,798

[22] PCT Filed: Mar. 7, 1995

[86] PCT No.: PCT/JP95/00360

§ 371 Date: Nov. 7, 1995

§ 102(e) Date: Nov. 7, 1995

[87] PCT Pub. No.: WO95/24595

PCT Pub. Date: Sep. 14, 1995

[30] Foreign Application Priority Data

Mar. 7, 1994 [JP] Japan ..... 6-064665

[51] Int. Cl.[6] ..... F25B 41/00

[52] U.S. Cl. ..... 165/110; 165/144; 165/111

[58] Field of Search ..... 165/144, 166, 165/110, 111; 62/23, 28, 630, 631

[56] References Cited

U.S. PATENT DOCUMENTS 3,874,184 4/1975 Harper et al. ..... 62/28

4,157,904 6/1979 Campbell et al. ..... 62/27

4,172,711 10/1979 Bailey ..... 62/21

4,430,103 2/1984 Gray et al. ..... 62/28

4,687,499 8/1987 Aghili ..... 62/24

4,690,702 9/1987 Paradowski et al. ..... 62/23

*Primary Examiner*—Allen J. Flanigan

*Attorney, Agent, or Firm*—Oblon, Spivak, McClelland, Maier & Neustadt, P.C.

[57] ABSTRACT

An object of the present invention is to minimize a volume of a hollow body by a combination of a horizontal H-letter shaped type gas-liquid separator and a plurality of plate-fin heat exchangers having a larger heat exchange performance per volume. In the present heat exchanging apparatus, fluid and refrigerants flow about in the hollow body through pipes while gas and liquid phases of the refrigerants are repeatedly separated and mixed for heat exchange between the fluid and the refrigerants. The apparatus comprises a plurality of plate-fin heat exchangers for exchanging heat between the refrigerants and the fluid, and a gas-liquid separator including upper and lower accommodation portions which are hollow cylinders laid in a horizontal direction both ends of which are airtightly sealed and an intermediate accommodation portion which connects the upper accommodation portion to the lower accommodation portion so as to form a sideways H-letter shape.

10 Claims, 5 Drawing Sheets

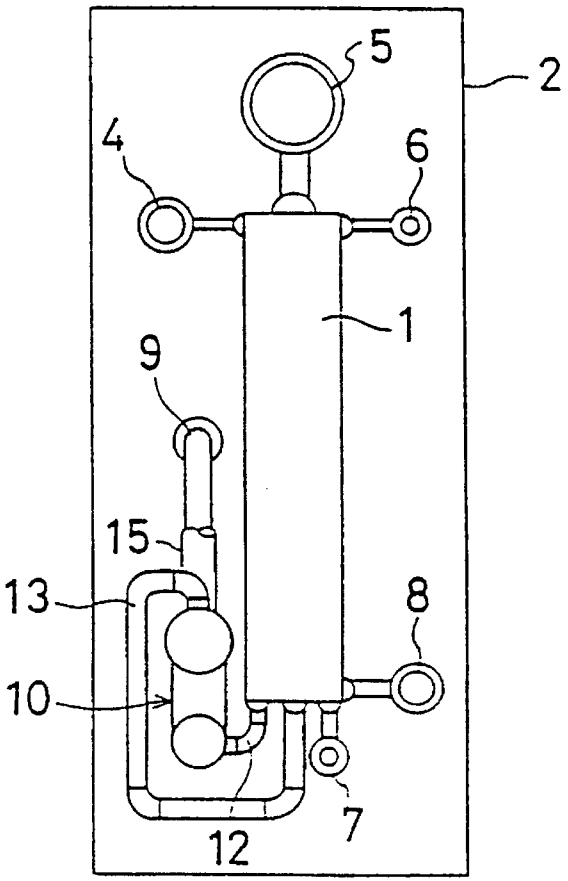
Fig. 1-(b)
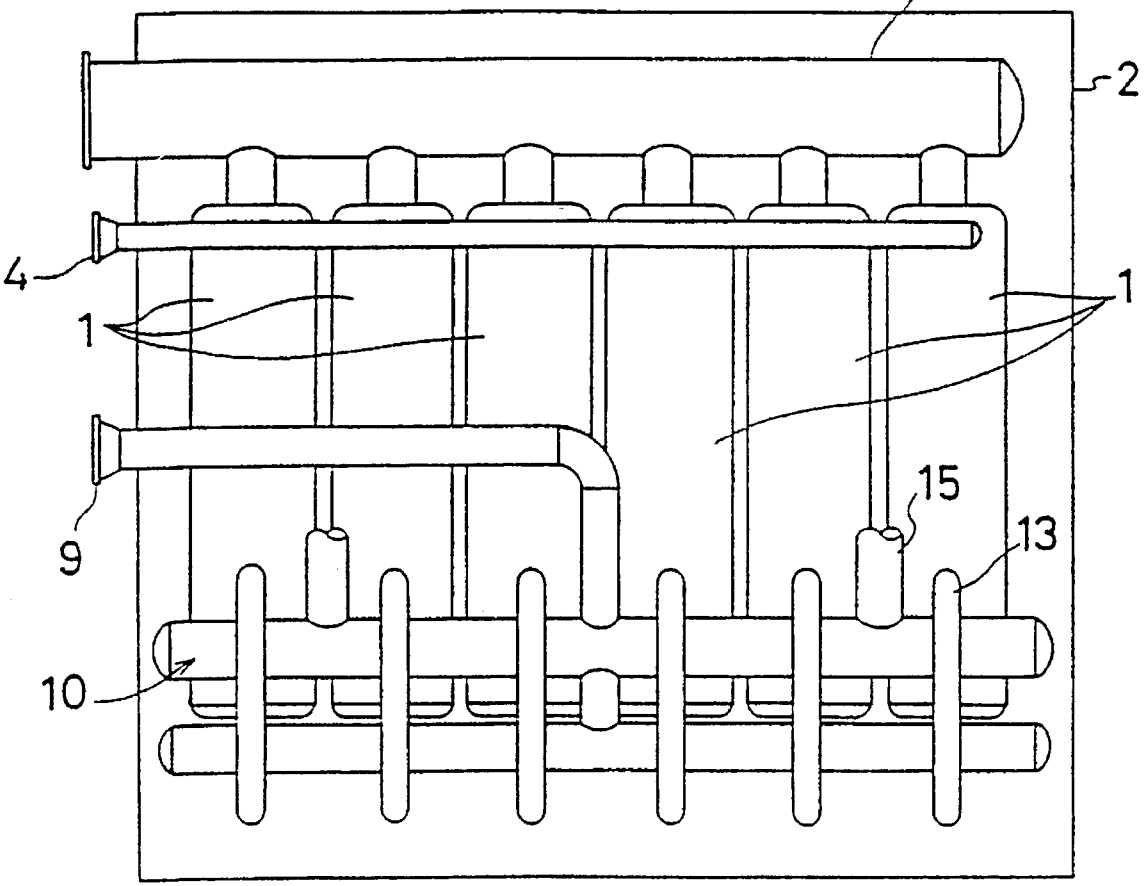
Fig. 1-(a)

HEAT EXCHANGING APPARATUS

TECHNICAL FIELD

This invention relates to an apparatus for exchanging heat which refrigerates fluid to be cooled to exchange heat between the fluid and the refrigerants. More particularly, while the fluid and the refrigerants flow through a hollow body through pipes, gas and liquid phases of the refrigerants are repeatedly separated and mixed for heat exchange between the fluid and the refrigerants.

BACKGROUND ART

Prior heat exchanging apparatuses have been equipped with a gas-liquid separator, which has a vertical or horizontal cylinder tank.

As shown in FIG. 4, a vertical type gas-liquid separator 51 has an inlet 51*c* on one side. The inlet 51*c* is connected to heat exchangers 53 through a flash valve 54. Also, the gas-liquid separator 51 has outlets 51*a* and 51*b* on its top and bottom respectively. The outlets 51*a* and 51*b* are connected to the heat exchangers 53 through mixers 52 which are incorporated into the heat exchangers 53 respectively. Accordingly, the discharged refrigerant from the heat exchangers 53 is adiabaticly expanded by the flash valve 54, and gets to the tank 51 where the refrigerants are separated into gas and liquid. Then the gas and liquid of the refrigerants are mixed together by the mixers 52 which are incorporated into the heat exchangers 53 respectively. Finally, the refrigerants are equally distributed to the heat exchangers 53 again.

As shown in FIG. 5, a horizontal type gas-liquid separator has an inlet 51*c* on the top of a tank 51. The inlet 51*c* is connected to heat exchangers 53 through a flash valve 54. Also the gas-liquid separator 51 has outlets 51*a* and 51*b* on its top and bottom respectively. The outlets 51*a* and 51*b* are connected to the heat exchangers 53 through mixers 52 which are incorporated into the heat exchangers 53 respectively. Accordingly, the discharged refrigerant from the heat exchangers 53 is adiabaticly expanded by the flash valve 54, and gets to the tank 51 where the refrigerant is separated into gas and liquid. Then the gas and liquid of the refrigerants are mixed together by the mixers 52 which are incorporated into the heat exchangers 53 respectively. Finally, the refrigerants are equally distributed to the heat exchangers 53 again.

However, the above-prior heat exchanging apparatus which equips the heat exchangers 53 and the vertical type gas-liquid separator in a hollow body requires a common pipe which joints the distribution pipes to the gas-liquid separator for distributing the refrigerants to the plurality of heat exchangers 53 because it is difficult for many pipes which are connected to the gas-liquid separator to be set up in a plane. Moreover, the vertical type gas-liquid separator tends to have a bigger diameter than the horizontal type gas-liquid separator because it has a larger sectional area for gas phase flowing up in the gas-liquid separator. Therefor the prior heat exchanging apparatus having the vertical type gas-liquid separator in the hollow body has a problem of the hollow body being large in size.

Also, the above-prior heat exchanging apparatus which equips the heat exchangers 53 and the horizontal type gas-liquid separator in a hollow body has some problems. When a horizontally longer type of gas-liquid separator is applied, the pipes for distributing to the plurality of heat exchangers 53 are decreased in number and a larger sectional area for gas phase flowing up is obtained in its smaller diameter than the vertical type gas-liquid separator. But a fluctuation range of a liquid level is limited. Therefore, the above-prior heat exchanging apparatus having the horizontal type gas-liquid separator in a hollow body has a problem in its operation. Moreover, when different kinds of refrigerants are applied, the different kinds of refrigerants have to be uniformly mixed in each of gas and liquid phases as well as a separation gas from liquid before distributing the refrigerants to the plurality of the heat exchangers 53. Nevertheless, as the horizontal type gas-liquid separator is long in a horizontal direction, it may cause a non-uniformity of the refrigerant's components at each of the pipes connected to the plurality of heat exchangers 53 respectively.

SUMMARY OF THE INVENTION

Accordingly, it is an object of the present invention to provide for a heat exchanging apparatus which equips heat exchangers and a horizontal type gas-liquid separator in a hollow body, which enables the hollow body to become small in size, enables a fluctuation range of a liquid level without any problems of operation to be obtained, enables the mixture of two or more kinds of refrigerants sufficiently, and enables the distribution of the uniformly mixed refrigerants to the plurality of heat exchangers.

DISCLOSURE OF INVENTION

The present heat exchanging apparatus which resolves the above problems of the prior heat exchanging apparatus where fluid to be cooled and refrigerants flow through a hollow body through pipes, while the gas and liquid phases of the refrigerants are repeatedly separated and mixed for heat exchange between the fluid and the refrigerants, has features as follows.

That is, the present heat exchanging apparatus comprises a plurality of plate-fin heat exchangers for exchanging heat between the refrigerants and the fluid and a horizontal H-letter shaped type of gas-liquid separator which includes an upper accommodation portion which is a hollow cylinder laid in a horizontal direction both ends of which are airtightly sealed, a lower accommodation portion which is a hollow cylinder laid in a horizontal direction both ends of which are airtightly sealed, and an intermediate accommodation portion which connects the upper accommodation portion to the lower accommodation portion so that the refrigerants may flow through while forming an H-letter shape.

According to the above structure, the gas-liquid separator enables distribution pipes to be directly connected to the heat exchangers without the common pipe which joints the distribution pipes to the gas-liquid separator because it is installed so as to be longer in the horizontal direction than the vertically cylindrical tank. Moreover, the installed gas-liquid separator which is longer in the horizontal direction can more easily provide the sectional area for gas phase flowing up than the vertical type. Also, its diameter can be smaller than the vertical type which prevents the volume of the hollow body from increasing. Further, with the intermediate accommodation portion, the fluctuation range of the liquid level in operation can be enlarged in comparison with a horizontally cylindrical tank having the same diameter. Therefore, an improvement of operation can be achieved. Furthermore, when two or more different kinds of refrigerants are supplied into the upper accommodation portion, each liquid phase is mixed with together while going through the intermediate accommodation portion. So that, it is possible to distribute the liquid phase with uniformity of composition in comparison with a horizontally cylindrical tank. Accordingly, the horizontally H-letter shaped type gas-liquid separator and the plurality of plate-fin heat exchangers having a larger heat exchange performance per volume, make it possible to minimize a volume of the hollow body keeping the same performance for separating and mixing gas and liquid.

BRIEF DESCRIPTION OF DRAWINGS

FIG. 1(*a*) is a side view of a schematic internal construction, of a heat exchanging apparatus of the present invention.

FIG. 1(*b*) is a front view of a schematic internal construction, of a heat exchanging apparatus of the present invention.

BEST MODE FOR CARRYING OUT THE INVENTION

Figure 2:
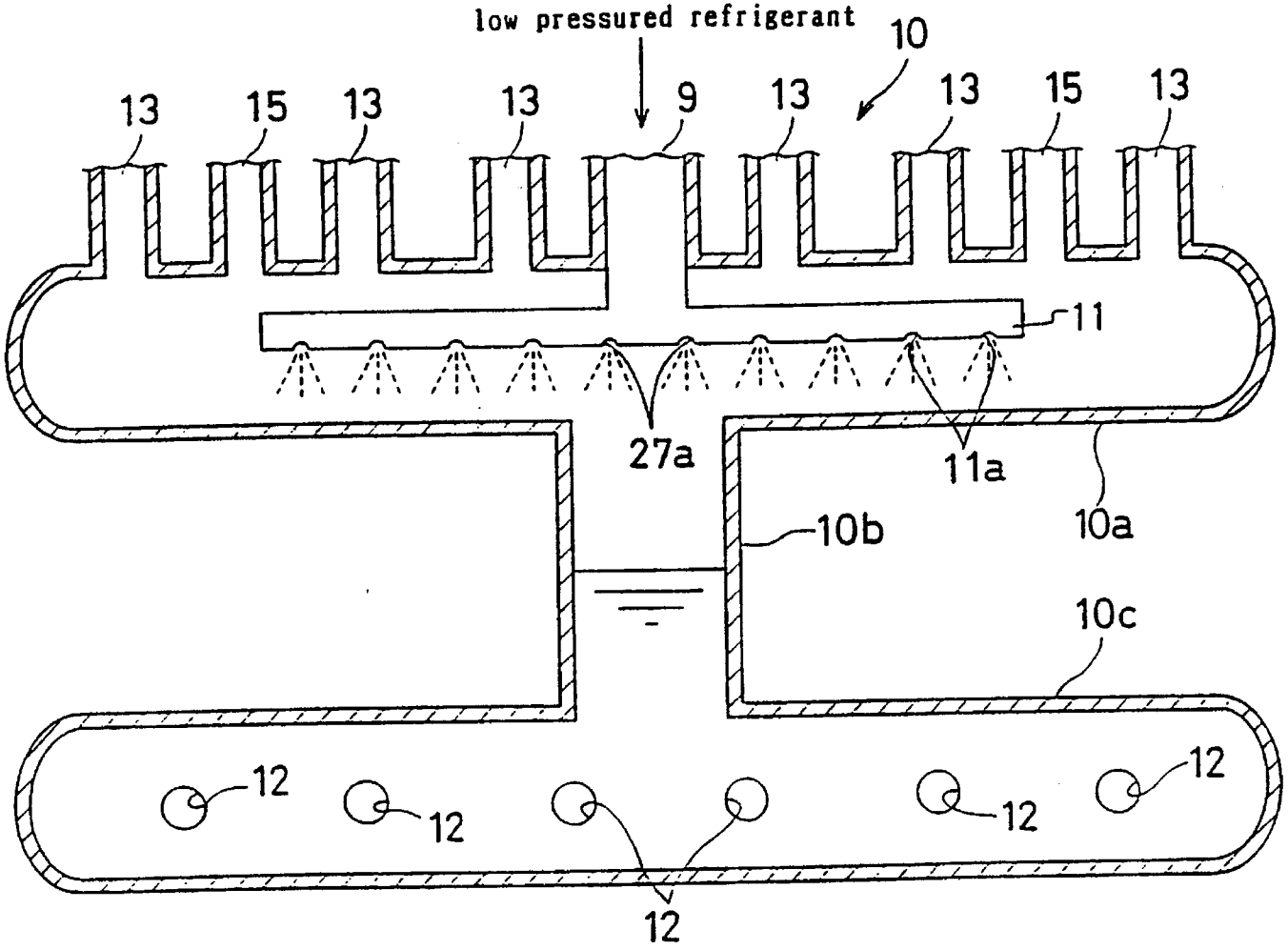
FIG. 2 is a longitudinal section view of a gas-liquid separator.
Figure 3:
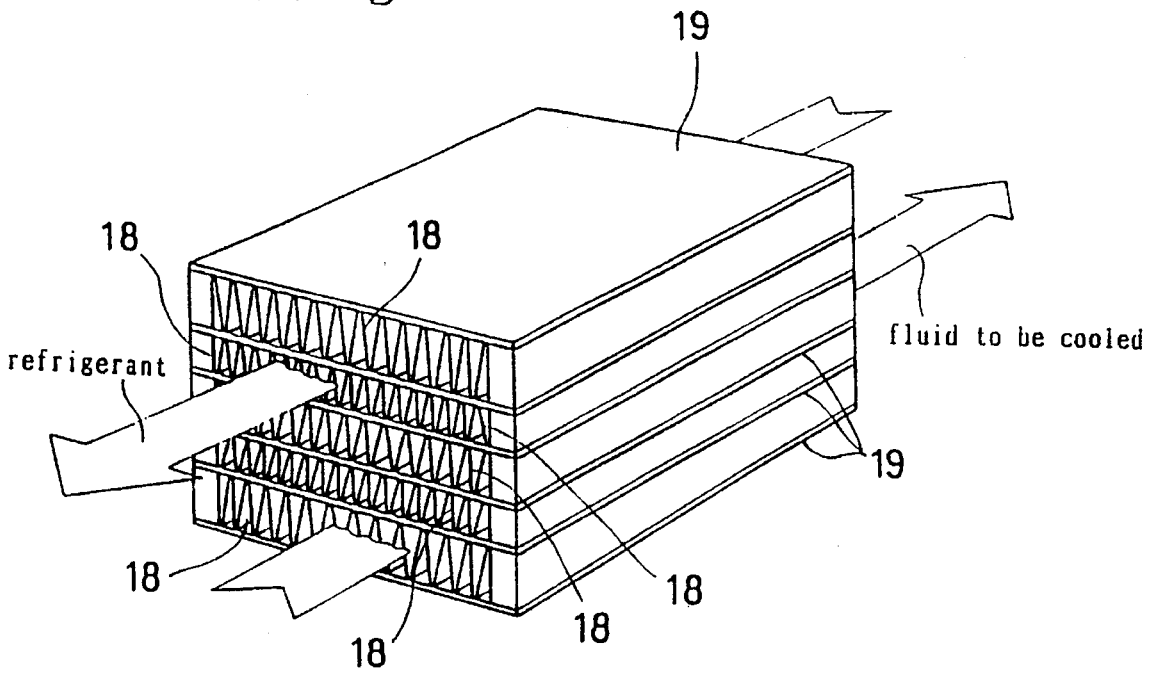
FIG. 3 is a perspective view of a plate-fin heat exchanger.
Figure 4:
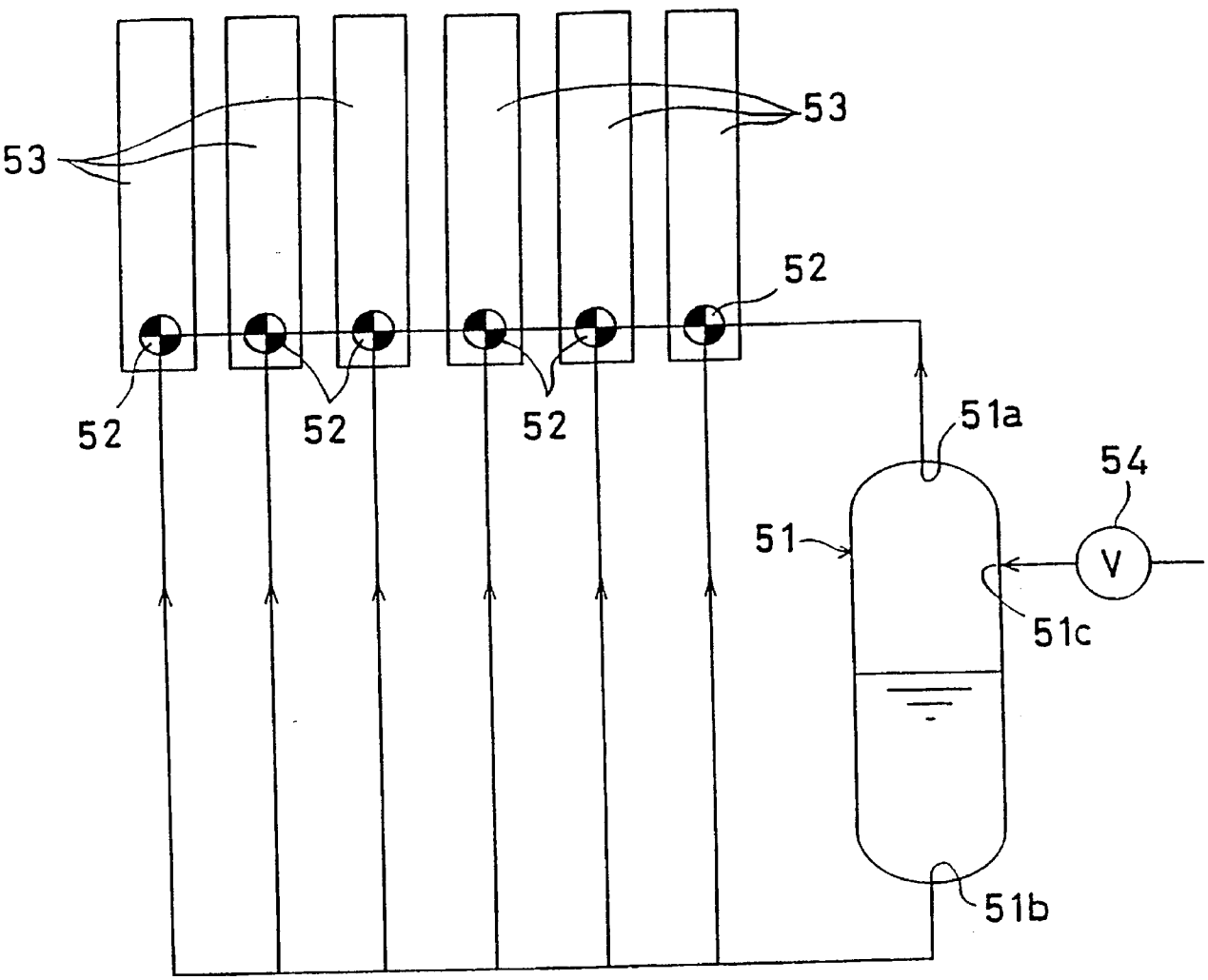
FIGS. 4 and 5 are block diagrams of a conventional heat exchanging apparatus.
Figure 5:
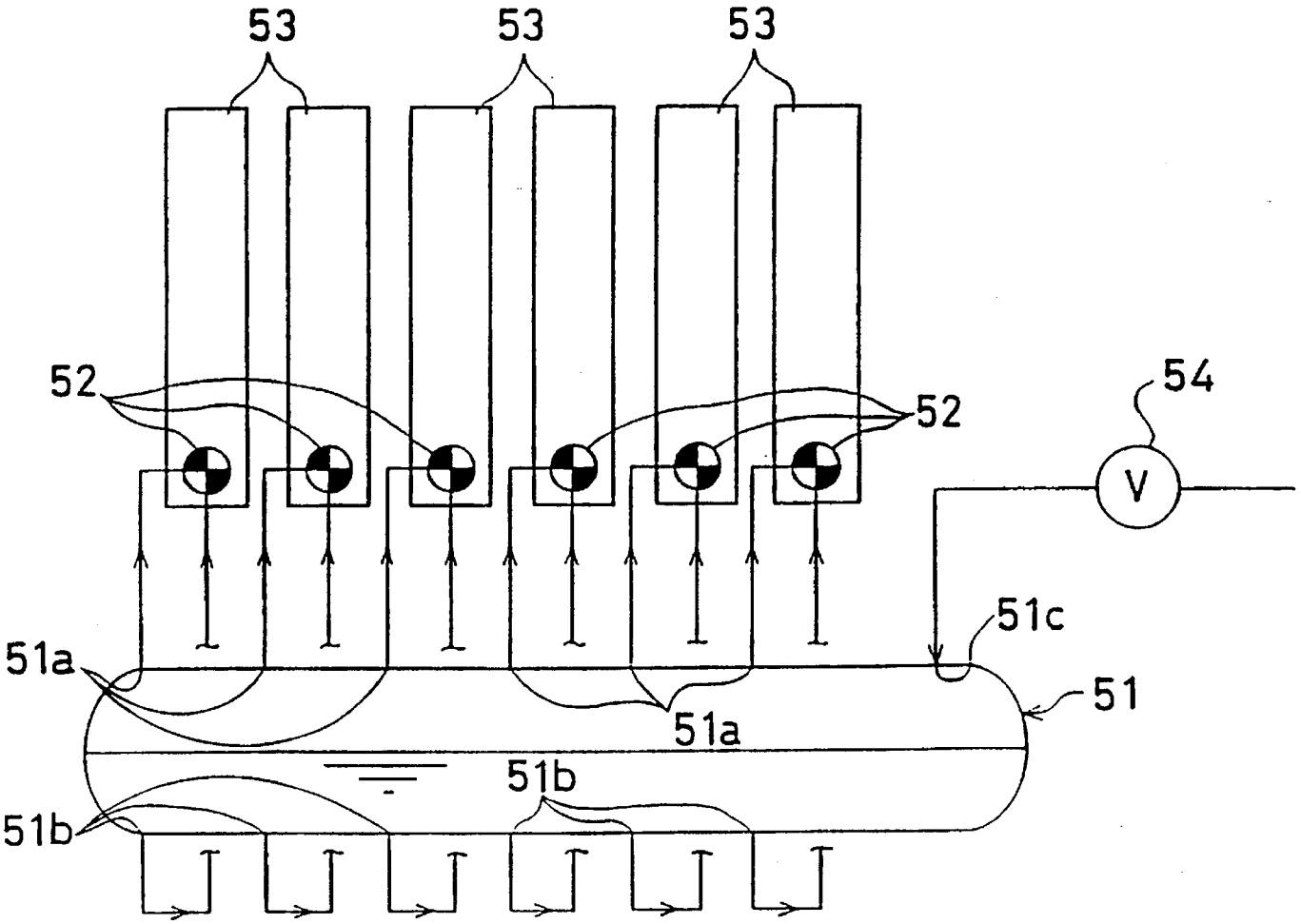

One feature of the present invention will become apparent from the following FIG. 1 through FIG. 3.

A heat exchanging apparatus of the present invention with reference to FIG. 1(*a*) has a plurality of plate-fin heat exchangers 1 in a hollow body 2. The plate-fin heat exchanger 1, as shown in FIG. 3, has a construction where corrugated fins 18 and plates 19 are laminated alternately, so that a fluid path and a refrigerant path are alloted alternately between each of the plates 19, so as to put the fluid to be cooled in touch with the refrigerants through plates 19. Heat is transferred through the corrugation fins 18 and the plates 19.

Each of the plate-fin heat exchangers 1 has three kinds of passages. High pressured refrigerants flow through the first passage, and low pressured refrigerants flow through the second passage. The high pressured refrigerants are supplied into the first passage through a first pipe 4 which is connected to the top end of the first passage as shown in FIGS. 1(*a*)–1(*b*). On the other hand, the low pressured refrigerants go out the second passage through a second pipe 5 which is connected to the top end of the second passage. The high pressured refrigerants go down through the first passage in the plate-fin heat exchanger 1, and the low pressured refrigerants go up through the second passage in the plate-fin heat exchanger 1.

The fluid to be cooled is supplied into the third passage through a third pipe 6 which is connected to the top end of the third passage. The fluid which has been cooled by heat exchanging goes out the third passage through a fourth pipe 7 which is connected to the bottom end of the third passage.

The bottom end of the first passage is connected to a flash valve through a fifth pipe 8 which collects the refrigerants and runs along to the wall of the plate-fin heat exchangers 1. The flash valve which is not shown in FIGS. 1(*a*)–1(*b*) is connected to a gas-liquid separator 10 through a sixth pipe 9 which collects the refrigerants and runs along a wall of the plate-fin heat exchangers 1. The above gas-liquid separator 10 comprises a horizontally H-letter shaped type of tank. The wall of the plate-fin heat exchangers 1 and a plane including the H-letter shape of the tank are in parallel with each other.

In other words, the gas-liquid separator 10, as illustrated in FIG. 2, consists of an upper accommodation portion 10*a*, an intermediate accommodation portion 10*b* and a lower accommodation portion 10*c*. The upper accommodation portion 10*a* is a hollow cylinder laid in a horizontal direction both ends of which are airtightly sealed.

An injection element 11 having many injection holes 11*a* is provided in the upper accommodation portion 10*a*. The injection element 11 is connected to the sixth pipe 9 which is jointed to the upper accommodation portion 10*a* of the gas-liquid separator 10. The liquid of the refrigerants coming out of the above-said flash valve is discharged into the upper accommodation portion 10*a*.

A seventh pipe 15 is also connected to the upper accommodation portion 10*a*. Other kinds of refrigerants go through the seventh pipe 15 into the upper accommodation portion 10*a* under the condition that gas and liquid phases are mixed, which have different components from the refrigerants going into and through the sixth pipe 9.

The center position of the upper accommodation portion 10*a* is connected to a top end of the intermediate accommodation portion 10*b* which is a vertical hollow cylinder. The bottom end of the intermediate accommodation portion 10*b* is connected to the lower accommodation portion 10*c* which is a hollow cylinder laid in a horizontal direction both ends of which are airtightly sealed. The intermediate accommodation portion 10*b* connects the upper accommodation portion 10*a* to the lower accommodation portion 10*c* so that the refrigerants can flow while forming an H-letter shape in a horizontal direction. The gas-liquid separator 10 handles different kinds of the refrigerants supplied from the seventh pipe 15 and the injection element 11 as follows. The liquid of both of the refrigerants are accommodated at the lower accommodation portion 10*c* after mixing in the intermediate accommodation portion 10*b*. On the other hand, the gas of the refrigerants are mixed and accommodated at the upper accommodation portion 10*a*. Thus, the gas-liquid separator 10 can separate the gas of the refrigerants from the liquid of the refrigerants with uniformity as respect to components respectively.

Eighth pipes 13 are connected to the upper accommodation portion 10*a* and ninth pipes 12 are connected to the lower accommodation portion 10*c*. These pipes 13 and 12 are connected to unillustrated mixers which are provided in the plate-fin heat exchangers to each. These pipes 13 and 12 distribute gas and liquid phases of the refrigerants to the mixers respectively. After mixing the gas phase with the liquid phase of the refrigerants, the mixers send them to the passages in the plate-fin heat exchangers 1.

The assembly of the heat exchanging apparatus in the above construction will become apparent from the following description.

At first, the first pipe 4 and the second pipe 5 are connected to each of the plurality of the plate-fin heat exchangers 1 so that the plurality of the plate-fin heat exchangers 1 are united into one. These plate-fin heat exchangers 1 are fixed on the designed position of the hollow body 2 after, the gas-liquid separator 10 is set parallel to the wall of the plate-fin heat exchangers.

After these processes, each one of the ends of the pipes such as a the sixth pipes 9 or the seventh pipe 15 is connected to the gas-liquid separator 10 and each one of the other ends of the pipes is connected to the plate-fin heat exchangers or the un-illustrated flash valve.

At this time, the gas-liquid separator 10 consists of the horizontally H-letter shaped tank, and also the upper accommodation portion 10*a* is a hollow cylinder horizontally installed. Therefore, as illustrated in FIG. 2, it is possible to connect the pipes 9, 13 and 15 to the upper accommodation portion 10*a* in one plane including the H-letter of the tank even if there are alot of the pipes 9, 13 and 15. Finally, the pipes which are attached to the gas-liquid separator 10 can be placed in the same plane which includes the gas-liquid separator 10 which is parallel to the wall of the plate-fin heat exchangers.

Thus, the heat exchanging apparatus of the present invention comprises the gas-liquid separator 10 and the plate-fin heat exchangers 1 in the hollow body where each plate-fin heat exchanger 1 exchanges heat between the refrigerants and the fluid to be cooled, and also the fluid and the refrigerants flow about in a hollow body through the pipes (the first pipe 4 and so on) while gas and liquid of the refrigerants are repeatedly separated and mixed for heat exchange between the refrigerants and the fluid to be cooled such as a natural gas. The gas-liquid separator 10 is characterized by comprising the upper accommodation portion 10*a* and the lower accommodation portion 10*c* which are hollow cylinders laid in a horizontal direction both ends of which are airtightly sealed and the intermediate accommodation portion 10*b* which connects the upper accommodation portion 10*a* to the lower accommodation portion 10*c* so that the refrigerants may flow through while forming an H-letter shape in the horizontal direction.

The distribution pipes from the gas-liquid separator 10 can be connected directly to plate-fin heat exchangers 1 without a common pipe since the gas-liquid separator 10 is set longer horizontally in comparison with a vertically cylindrical tank.

Moreover, being horizontally longer facilitates obtaining the section area for gas flowing up in comparison with the vertical type of gas-liquid separator, and as a result of that, it is possible to minimize the diameter of the hollow body and to prevent the volume of the hollow body from increasing.

Also, the intermediate accommodation portion 10*b* enables the fluctuation range of the liquid level in operation to become larger in comparison with a horizontally cylindrical tank having the same diameter, so that, the operation of the present heat exchanging apparatus is improved. Further, when two or more different kinds of refrigerants are supplied into the upper accommodation portion 10*a*, their liquid phase are mixed with each other while they go through the intermediate accommodation portion 10*b*, so that, it is possible to distribute the liquid phase with uniformity of composition in comparison with a horizontally cylindrical tank. Accordingly, the horizontally H-letter shaped type of gas-liquid separator 10 and the plurality of plate-fin heat exchangers 1 having a larger heat exchange performance per volume, makes it possible to minimize the volume of the hollow body while keeping the same performance for separating and mixing gas and liquid.

The above example of the present invention shows only one intermediate accommodation portion 10*b* which connects the upper accommodation portion 10*a* to the lower accommodation portion 10*c* so that the refrigerants may go through. However, the intermediate accommodation portion 10*b* is not limited to one in number. A plurality of intermediate accommodation portions 10*b* are applicable. The efficiency of mixing in the case of a plurality of intermediate accommodation portions 10*b* may be inferior to mixing in the case of a single intermediate accommodation portion 10*b*; however, a stability of the liquid level in operation is improved because the cross section area of the intermediate accommodation portions 10*b* is wider.

In the manner as stated above, the present invention of the heat exchanging apparatus refrigerates the fluid to be cooled while the fluid and the refrigerant flow about in the hollow body through pipes so that the gas and liquid of the refrigerants may be repeatedly separated and mixed for heat exchange between the fluid and the refrigerants. The present heat exchanging apparatus comprises the plurality of plate-fin heat exchangers for exchanging heat between the refrigerants and the fluid, and the horizontally H-letter shaped type gas-liquid separator in the hollow body. The gas-liquid separator includes the upper and lower accommodation portions which are hollow cylinders laid in a horizontal direction both ends of which are airtightly sealed, and the intermediate accommodation portion which connects the upper accommodation portion to the lower accommodation portion so that the refrigerants may go through while forming an H-letter shape.

According to the above structure, the present invention can not only have a reduced diameter with respect to the vertically cylindrical tank but also a simplified pipe system for distributing the separated gas and liquid. In addition to that, the present invention provides for a wider fluctuation range of the liquid level in comparison with the vertically cylindrical tank and a more efficient mixture of several kinds of liquids having different compositions by working of the intermediate accommodation portion. By a combination of the horizontal H-letter shaped type gas-liquid separator and the plurality of plate-fin heat exchangers having a larger heat exchange performance per volume, it is possible to minimize a volume of the hollow body keeping the same performance for separating and mixing gas and liquid.

APPLICABILITY

In conclusion, the present invention is suitable as a heat exchanging apparatus which equips the heat exchangers and the horizontal type gas-liquid separator in a hollow body, which enables the hollow body to become small in size, enables a fluctuation range of a liquid level without any problems of operation to be obtained, enables a mixture of two or more kinds of refrigerants sufficiently and enables the distribution of the uniformly mixed refrigerants to the plurality of heat exchangers.

We claim:

1. A heat exchanging apparatus comprising:

a gas-liquid separator to separate gas and liquid phases of refrigerants;

a plurality of plate-fin heat exchangers for exchanging heat between said refrigerants and a fluid to be cooled; and a hollow body containing said plurality of plate-fin heat exchangers and said gas-liquid separator, wherein:

said plurality of plate-fin heat exchangers are arranged in their upright position; and said gas-liquid separator includes:

an upper accommodation portion which is a hollow cylindrical member laid in a horizontal direction both ends of which are airtightly sealed;

a lower accommodation portion which is a hollow cylindrical member laid in the horizontal direction both ends of which are airtightly sealed; and an intermediate accommodation portion which connects said upper accommodation portion to said lower accommodation portion so that the refrigerants may flow through and so as to form a sideways H-letter shape in the horizontal direction;

a plane including said H-letter shape of said gas-liquid separator is parallel to a wall of said plate-fin heat exchangers.

2. A heat exchanging apparatus as claimed in claim 1, in which;

collecting pipes for collecting and indirectly sending the refrigerants from said heat exchangers to said gas-liquid separator are installed along said wall of said plate-fin heat exchangers.

3. A heat exchanging apparatus as claimed in claim 1, in which;

distributing pipes for distributing or collecting the refrigerants are connected to the upper accommodation portion of said gas-liquid separator in one plane including said H-letter shape of said gas-liquid separator.

4. A heat exchanging apparatus as claimed in claim 1, in which:

each of said distributing pipes for distributing the refrigerants from said gas-liquid separator to said plate-fin heat exchangers directly connects said gas-liquid separator to said plate-fin heat exchangers without a common pipe.

5. A heat exchanging apparatus as claimed in claim 1, in which:

an injection material having many injection holes for discharging the refrigerants is provided in said upper accommodation portion of said gas-liquid separator.

6. A heat exchanging apparatus comprising:

a gas-liquid separator to separate gas and liquid phases of refrigerants;

a plurality of plate-fin heat exchangers for exchanging heat between said refrigerants and a fluid to be cooled; and a hollow body containing said plurality of plate-fin heat exchangers and said gas-liquid separator, wherein:

said plurality of plate-fin heat exchangers are arranged in their upright position; and said gas-liquid separator includes:

an upper accommodation portion which is a hollow cylindrical member laid in a horizontal direction both ends of which are airtightly sealed;

a lower accommodation portion which is a hollow cylindrical member laid in the horizontal direction both ends of which are airtightly sealed; and a plurality of intermediate accommodation portions which connect said upper accommodation portion to said lower accommodation portion so that the refrigerants may flow through while forming a sideways H-letter shape in the horizontal direction;

a plane including said H-letter shape of said gas-liquid separator is parallel to a wall of said plate-fin heat exchangers.

7. A heat exchanging apparatus as claimed in claim 6, in which:

collecting pipes for collecting and indirectly sending the refrigerants from said heat exchangers to said gas-liquid separator are installed along said wall of said plate-fin heat exchangers.

8. A heat exchanging apparatus as claimed in claim 6, in which:

distributing pipes for distributing or collecting the refrigerants are connected to the upper accommodation portion of said gas-liquid separator in one plane including said H-letter shape of said gas-liquid separator.

9. A heat exchanging apparatus as claimed in claim 6, in which:

each of the distributing pipes for distributing the refrigerants from said gas-liquid separator to said plate-fin heat exchangers directly connects said gas-liquid separator to said plate-fin heat exchangers without a common pipe.

10. A heat exchanging apparatus as claimed in claim 6, in which:

an injection material having many injection holes for discharging the refrigerants is provided in said upper accommodation portion of said gas-liquid separator.

* * * * *